US010138108B2

(12) United States Patent
Taha et al.

(10) Patent No.: US 10,138,108 B2
(45) Date of Patent: Nov. 27, 2018

(54) GAS-LIQUID MIXING DEVICE OF BEVERAGE

(71) Applicant: ADT (China) Ltd., Ningbo, Zhejiang (CN)

(72) Inventors: Max Taha, Zhejiang (CN); Ruofeng Weng, Zhejiang (CN)

(73) Assignee: ADT (CHINA) LTD., Ningbo, Zhejiang (CN)

( * ) Notice: Subject to any disclaimer, the term of this patent is extended or adjusted under 35 U.S.C. 154(b) by 248 days.

(21) Appl. No.: 14/981,477

(22) Filed: Dec. 28, 2015

(65) Prior Publication Data

US 2016/0238311 A1 Aug. 18, 2016

(30) Foreign Application Priority Data

Feb. 12, 2015 (CN) ..... 2015 1 0087853

(51) Int. Cl.
*B67D 1/00* (2006.01)
*F25D 31/00* (2006.01)

(52) U.S. Cl.
CPC ..... *B67D 1/0067* (2013.01); *F25D 31/002* (2013.01)

(58) Field of Classification Search
CPC ... F25D 31/002; F25D 31/003; B67D 1/0057; B67D 1/006; B67D 1/0061; B67D 1/0063; B67D 1/0067
See application file for complete search history.

(56) References Cited

U.S. PATENT DOCUMENTS 2,514,463 A * 7/1950 Bayers, Jr. ..... B01F 3/04808 261/124
2,541,757 A * 2/1951 Grier ..... B01F 3/04808 165/115
3,058,620 A * 10/1962 Kromer ..... B67D 1/0406 137/12.5
4,764,315 A * 8/1988 Brusa ..... B01F 3/04808 261/123
5,622,055 A * 4/1997 Mei ..... F25B 40/00 62/113

* cited by examiner

*Primary Examiner* — Elizabeth J Martin
(74) *Attorney, Agent, or Firm* — Novick, Kim & Lee, PLLC; Allen Xue

(57) ABSTRACT

A gas-liquid mixing device of a beverage is provided. The gas-liquid mixing device has a container, a liquid inlet pipe, a gas inlet pipe and a liquid discharging pipe configured to discharge liquid, wherein the container is provided with a refrigeration evaporator; the container is further internally provided with a liquid precooling pipe; the liquid entering at the earliest enters the container through the liquid precooling pipe and is stored in the container and cooled by the refrigeration evaporator; the cooled liquid precools the liquid entering the liquid precooling pipe subsequently; the precooled liquid in the container is mixed and dissolved with entering gas; the container is further internally provided with a liquid molecule expander comprising a precooling liquid container inlet and a collision wall; the precooled liquid is ejected to the collision wall through the precooling liquid container inlet.

12 Claims, 3 Drawing Sheets

GAS-LIQUID MIXING DEVICE OF BEVERAGE

TECHNICAL FIELD

The invention relates to a beverage making tool, in particular to a gas-liquid mixing device of a beverage.

BACKGROUND

For the beverage, gas shall be mixed into the liquid beverage usually. For example, much carbon dioxide shall be dissolved into the beverage when a carbonated beverage is prepared, and water and carbon dioxide are generally pressed into the gas-liquid mixing device of the beverage to achieve dissolution of carbon dioxide in water in the gas-liquid mixing device of the beverage. A main structure in the prior art is as follows: a liquid pipeline extends into a container of the gas-liquid mixing device, a micropore penetrating a pipe wall is formed in a side wall of the pipeline to form a venturi pipe structure, a high-pressure water flow in the pipeline generates negative pressure at a micropore area, and the negative pressure sucks gas outside the pipeline into the pipe to be mixed and dissolved with the water.

The defects in the prior art lie in that liquid in the pipeline is not subjected to low temperature treatment and has higher temperature; the temperature of the water will also rise after pressurization; the high temperature water reduces a dissolution rate of the gas; the gas is not subjected to cooling treatment, a content of the gas dissolved into the liquid is limited, and the quality of the beverage is influenced; in addition, the prepared beverage is higher in temperature and must be cooled, and an external refrigeration device is required to cool the prepared beverage, so that the cost is increased, the size of beverage preparation equipment is also increased, and an application scope of the equipment is reduced.

SUMMARY

In order to overcome the defects in the prior art, the invention adds a refrigeration device and a precooling device in a gas-liquid mixing device to precool liquid before mixing and increase a dissolution rate of gas in the liquid. At the same time, external cooling is not required for a prepared liquid beverage, the size of equipment is reduced, and an application scope of the equipment is expanded.

The invention provides a gas-liquid mixing device of a beverage. The gas-liquid mixing device comprises a container, a liquid inlet pipe configured to allow liquid to enter the container, a gas inlet pipe configured to allow gas to enter the container, and a liquid discharging pipe configured to discharge the liquid, wherein the container is externally provided with a refrigeration evaporator; the refrigeration evaporator is connected with an external refrigeration device and cools the container; the container is further internally provided with a liquid precooling pipe; a liquid inlet of the liquid precooling pipe is connected with the liquid inlet pipe; the liquid entering at the earliest enters the container through the liquid precooling pipe, and is stored in the container and cooled by the refrigeration evaporator; the cooled liquid in the container precools the liquid entering the liquid precooling pipe subsequently; after mixed and dissolved with the gas entering through the gas inlet pipe, the precooled liquid in the container is discharged through the liquid discharging pipe; the liquid entering the container is continuously replaced by the liquid entering the container later; a liquid molecule expander is further arranged in the container and comprises a precooling liquid container inlet connected with a liquid outlet of the liquid precooling pipe, and a collision wall arranged in the container; the precooling liquid container inlet ejects the precooled liquid to the collision wall; the distances between many liquid molecules generated after the liquid collides the collision wall are increased; and the amount of the gas dissolved into the liquid is increased.

In the above technical scheme, the collision wall comprises a collision sheet; the precooling liquid container inlet is formed according to a particular position and a shape of the collision wall; an angle of the precooling liquid container inlet to the collision wall may be right or oblique; and a contact position of the ejected liquid and the collision wall may be arranged above or below a water level of water stored in the container, which is determined according to the pressure of the liquid and the preset dissolution rate of the liquid.

In the above technical scheme, the collision wall comprises a container wall; the precooling liquid container inlet is formed according to a particular position and a shape of the collision wall; an angle of the precooling liquid container inlet to the collision wall is oblique; and a contact position of the ejected liquid and the collision wall may be arranged above or below a water level of water stored in the container, which is determined according to the pressure of the liquid and the preset dissolution rate of the liquid.

In the above technical scheme, the liquid precooling pipe is in a spiral coil structure to increase surface area and facilitate sufficient heat exchange with the cooled liquid in the container.

In the above technical scheme, the refrigeration evaporator is in a coil structure and is coiled outside the container wall to provide the refrigeration capacity required by the container.

In the above technical scheme, the container is internally provided with a temperature sensor to monitor the temperature of the liquid in the container, and control equipment adjusts liquid inlet amount or the refrigeration capacity according to a value provided by the sensor to keep the liquid within a set temperature scope.

In the above technical scheme, the container is further internally provided with a pressure sensor to monitor the pressure of gas in the container and keep the gas within a set pressure scope.

In the above technical scheme, the container is internally provided with a liquid level sensor to monitor a liquid level in the container; the liquid amount in the container is adjusted by data of the liquid level sensor; the liquid level sensor is externally sleeved with a protection sleeve; the protection sleeve comprises a hard pipe body; the precooling liquid container inlet is formed outside the protection sleeve, so that the precooled liquid injected into the container does not damage a device in the protection sleeve.

Compared with the prior art, the invention adds a pre-refrigeration pipe in the gas-liquid mixing device and the refrigeration device outside the container to precool the liquid before mixing and increase the dissolution rate of the gas in the liquid. At the same time, the external cooling is not required for the prepared liquid, the size of the equipment is reduced, and the application scope of the equipment is expanded. The liquid molecule expander arranged increases the distances between the liquid molecules, further increases the dissolution rate of the gas and ensures that the liquid beverage with a high gas content is produced.

The drawings are marked with the following reference signs according to the drawings:

1—Container, 11—Container cover, 12—Liquid inlet, 13—Liquid outlet of liquid precooling pipe, 14—Precooling liquid container inlet, 14'—Precooling liquid container inlet, 15—Gas inlet, 16—Temperature sensor, 17—Pressure sensor, 18—Liquid level sensor, 19—Protection sleeve, 2—Refrigeration evaporator, 3—Liquid precooling pipe, 4—Collision sheet, 5—Liquid discharging pipe.

EMBODIMENTS

Two particular embodiments of the invention are described in detail according to the drawings, but it shall be understood that the protection scope of the invention is not limited by the particular embodiments.

Embodiment 1

Figure 1:
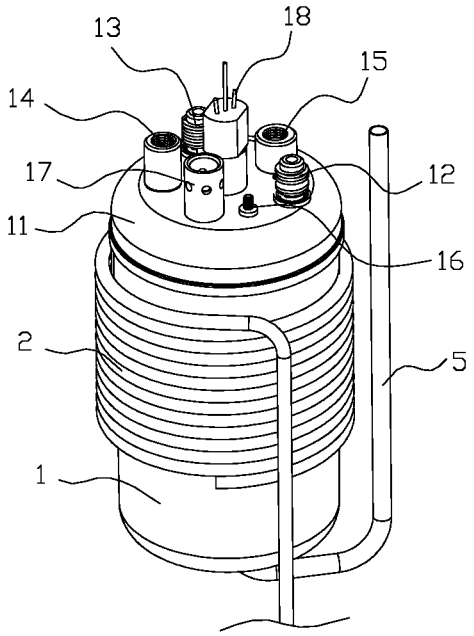
FIG. 1 is a stereogram of a gas-liquid mixing device of a beverage of the invention.
Figure 2:
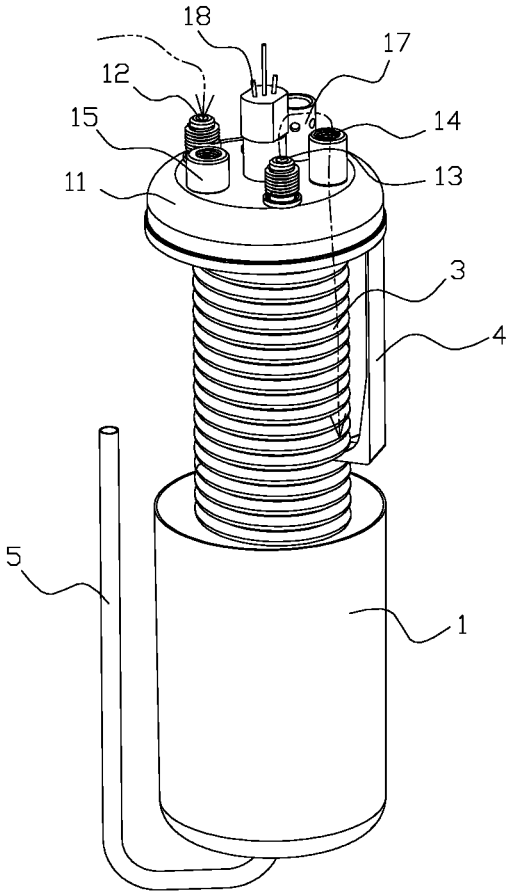
FIG. 2 is an exploded stereogram of a gas-liquid mixing device of a beverage of the invention.

The invention relates to a gas-liquid mixing device of a beverage as shown in FIGS. 1 and 2. The gas-liquid mixing device comprises a container 1, a liquid inlet pipe configured to allow liquid to enter the container 1, a gas inlet pipe configured to allow gas to enter the container 1, and a liquid discharging pipe 5 configured to discharge the liquid, wherein the container 1 is sealed by a container cover 11; the normal temperature liquid in the liquid inlet pipe (not shown in the figure) enters the container 1 through a liquid inlet 12 in the container cover 11; the gas in the gas inlet pipe (not shown in the figure) is communicated with the container 1 via a gas inlet 15 in the container cover 11; the container is provided with a refrigeration evaporator 2; the refrigeration evaporator 2 is in a coil pipe structure and is coiled outside a container wall; the refrigeration evaporator 2 is connected with an external refrigeration device (not shown in the figure) the container is further internally provided with a liquid precooling pipe 3; a liquid inlet of the liquid precooling pipe 3 is connected with the liquid inlet pipe via the normal temperature liquid inlet 12; the liquid enters a precooling pipe 3 (dash-dot-dot in FIG. 2) through the normal temperature liquid inlet 12; the liquid entering at the earliest enters the container 1 through the liquid precooling pipe 3, is stored in the container 1 and cooled by the refrigeration evaporator 2, and keeps set temperature; the cooled liquid precools the liquid entering the liquid precooling pipe 2 subsequently; the precooled liquid in the container 1 is mixed and dissolved with the gas enter through the gas inlet 15; the container 1 is further internally provided with a liquid molecule expander; the liquid molecule expander comprises a precooling liquid container inlet 14 connected with the liquid precooling pipe, and a collision wall; the precooled liquid is connected with the precooling liquid container inlet 14 via a pipeline (not shown in the figure) through a liquid outlet 13 of the liquid precooling pipe; the liquid outlet 13 of the liquid precooling pipe and the precooling liquid container inlet 14 are formed in the container cover 11; the precooling liquid container inlet 14 ejects the precooled liquid (shown as dash-dot-dot in FIG. 2) to the collision wall; the distances between many liquid molecules generated after the liquid collides the collision wall are increased; the amount of the gas dissolved into the liquid is increased; the liquid into which the gas is dissolved is discharged through the liquid discharging pipe 5; and the liquid entering the container at the earliest is continuously replaced by the liquid entering the container later.

Further, as shown in FIGS. 1 and 2, the collision wall comprises a collision sheet 4 (or may directly comprise the container wall in FIG. 2); the collision sheet 4 is in an L-shaped structure; the top of the collision sheet is connected with the container cover 11 in a fastening manner; the precooling liquid container inlet 14 is formed according to a particular position and a shape of the collision sheet; an angle of the precooling liquid container inlet 14 to the collision sheet may be right or oblique; and a contact position of the ejected liquid and the collision sheet 4 is at an L-shaped bottom; the L-shaped bottom may be arranged above or below a water level of water stored in the container, which is determined according to the pressure of the liquid and the preset dissolution rate of the liquid.

Further, as shown in FIG. 2, the liquid precooling pipe 3 is in a spiral coil structure; the L-shaped bottom of the collision sheet 4 is inserted into the spiral inner side of the liquid precooling pipe 3; and the precooling liquid container inlet 14 ejects the liquid to the collision sheet 4 from the top of the spiral inner side.

Further, as shown in FIGS. 1 and 2, the container is internally provided with a temperature sensor 16 to monitor the temperature of the liquid in the container, and control equipment adjusts liquid inlet amount or the refrigeration capacity according to a value provided by the sensor to keep the liquid within a set temperature scope.

Further, as shown in FIGS. 1 and 2, the container is further internally provided with a pressure sensor 17 to monitor the pressure of the gas in the container and keep the gas within a set pressure scope.

Figure 4:
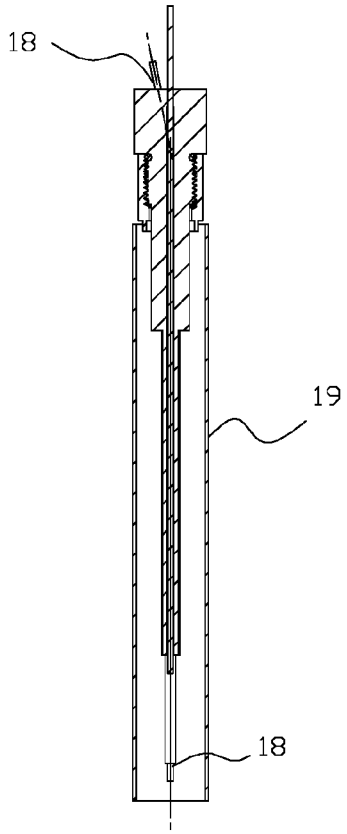
FIG. 4 is a section view of a liquid level sensor and a protection sleeve of a beverage of the invention.

Further, as shown in FIGS. 1, 2 and 4, the container is internally provided with a liquid level sensor 18 to monitor a liquid level in the container; the control equipment adjusts the liquid amount in the container according to the data of the liquid level sensor; the liquid level sensor 18 is externally sleeved with a protection sleeve 19; the protection sleeve comprises a hard pipe body; the precooling liquid container inlet 14 is formed outside the protection sleeve 19, so that the precooled liquid injected into the container does not damage a device in the protection sleeve.

Embodiment 2

Figure 3:
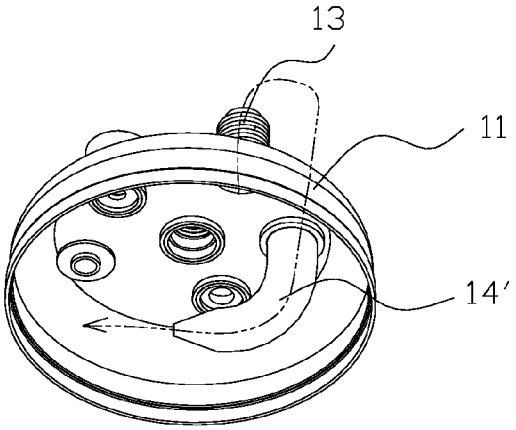
FIG. 3 is a section view of a gas-liquid mixing device of a beverage of the invention.

A gas-liquid mixing device of a beverage is as shown in FIG. 3. The difference from the embodiment 1 is that the precooling liquid container inlet 14' is in an elbow structure and is connected with the container cover 11 in a fastening manner; the liquid flows out of the liquid outlet 13 of the liquid precooling pipe is transmitted to the precooling liquid container inlet 14'; an outlet of the precooling liquid container inlet 14' faces a side wall of the container 1; a collision position of the liquid and the container wall may be above or below the liquid level of the liquid in the container; the liquid precooling pipe (not shown in the figure) avoids a liquid flow ejected from the precooling liquid container inlet 14' by a tensile or bias method and the like; and in addition, the precooling liquid container inlet 14' may also be formed in the side wall of the container to eject the liquid to another side wall of the container.

Compared with the prior art, the invention adds a liquid refrigeration pipe in the gas-liquid mixing device and the refrigeration device outside the container to precool the liquid before mixing and increase the dissolution rate of the gas in the liquid. At the same time, the external cooling is not required for the prepared liquid, the size of the equipment is reduced, and the application scope of the equipment is expanded. The liquid molecule expander arranged increases the distances between the liquid molecules, further increases the dissolution rate of the gas and ensures that the liquid beverage with a high gas content is produced.

The above disclosed is only two particular embodiments of the invention. However, the invention is not limited to this, and any change capable of being thought by one with skill in the art shall fall into the protection scope of the invention.

The invention claimed is:

1. A gas-liquid mixing device of a beverage, comprising a container, a liquid inlet pipe configured to allow liquid to enter the container, a gas inlet pipe configured to allow gas to enter the container, and a liquid discharging pipe configured to discharge the liquid, wherein the container is externally provided with a refrigeration evaporator; the container is further internally provided with a liquid precooling pipe; a liquid inlet of the liquid precooling pipe is connected with the liquid inlet pipe; after being mixed and dissolved with the gas entering through the gas inlet pipe, the precooled liquid in the container is discharged through the liquid discharging pipe; a liquid molecule expander is further arranged in the container and comprises a precooling liquid container inlet connected with the liquid precooling pipe, and a collision wall arranged in the container; and the precooling liquid container inlet ejects the precooled liquid to the collision wall, wherein the liquid precooling pipe is in contact with the liquid inside the container.

2. The gas-liquid mixing device of the beverage of claim 1, wherein the collision wall comprises a collision sheet; an angle of the precooling liquid container inlet to the collision wall is right or oblique; and a contact position of the ejected liquid and the collision wall is arranged above or below a water level of water stored in the container.

3. The gas-liquid mixing device of the beverage of claim 2, wherein the liquid precooling pipe is in a spiral coil structure.

4. The gas-liquid mixing device of the beverage of claim 2, wherein the container is internally provided with a temperature sensor.

5. The gas-liquid mixing device of the beverage of claim 2, wherein the container is internally provided with a pressure sensor.

6. The gas-liquid mixing device of the beverage of claim 2, wherein the container is further internally provided with a liquid level sensor; the liquid level sensor is sleeved with a protection sleeve; the protection sleeve comprises a hard pipe body; and the precooling liquid container inlet is formed outside the protection sleeve.

7. The gas-liquid mixing device of the beverage of claim 1, wherein the collision wall comprises a container wall; an angle of the precooling liquid container inlet to the collision wall is oblique; and a contact position of the ejected liquid and the collision wall is arranged above or below a water level of water stored in the container.

8. The gas-liquid mixing device of the beverage of claim 7, wherein the liquid precooling pipe is in a spiral coil structure.

9. The gas-liquid mixing device of the beverage of claim 7, wherein the container is internally provided with a temperature sensor.

10. The gas-liquid mixing device of the beverage of claim 7, wherein the container is internally provided with a pressure sensor.

11. The gas-liquid mixing device of the beverage of claim 7, wherein the container is further internally provided with a liquid level sensor; the liquid level sensor is sleeved with a protection sleeve; the protection sleeve comprises a hard pipe body; and the precooling liquid container inlet is formed outside the protection sleeve.

12. The gas-liquid mixing device of the beverage of claim 1, wherein the refrigeration evaporator is in a coil structure and is coiled outside a container wall.

* * * * *